US007523694B2

(12) United States Patent
Aday et al.

(10) Patent No.: US 7,523,694 B2
(45) Date of Patent: Apr. 28, 2009

(54) CYLINDER LINER PRELOAD SYSTEM

(75) Inventors: James C. Aday, McAlester, OK (US); Lopek Drzewiecki, Edmonton (CA); Michael J. Kubinski, Houston, TX (US); Andrew Dale Riley, Eufaula, OK (US)

(73) Assignee: National-Oilwell, L.P., Houston, TX (US)

( * ) Notice: Subject to any disclaimer, the term of this patent is extended or adjusted under 35 U.S.C. 154(b) by 413 days.

(21) Appl. No.: 11/288,919

(22) Filed: Nov. 29, 2005

(65) Prior Publication Data

US 2006/0123616 A1 Jun. 15, 2006

Related U.S. Application Data

(60) Provisional application No. 60/635,558, filed on Dec. 13, 2004.

(51) Int. Cl.
*F16J 12/00* (2006.01)

(52) U.S. Cl. ..... 92/171.1

(58) Field of Classification Search ..... 92/86.5, 92/169.1, 170.1, 171.1
See application file for complete search history.

(56) References Cited

U.S. PATENT DOCUMENTS

| | | | | |
|---|---|---|---|---|
| 2,678,247 | A * | 5/1954 | Geyer et al. | 92/170.1 |
| 3,128,941 | A | 4/1964 | Waibel | |
| 3,370,545 | A | 2/1968 | Waibel | |
| 4,930,404 | A | 6/1990 | Zbinden | |
| 6,463,843 | B2 * | 10/2002 | Pippert | 92/170.1 |
| 6,491,882 | B1 * | 12/2002 | Van Den Berg et al. | 92/171.1 |

FOREIGN PATENT DOCUMENTS

| | | |
|---|---|---|
| DE | 2846172 | 4/1980 |
| DE | 4029295 | 3/1992 |

OTHER PUBLICATIONS

International Search Report for Appln. No. PCT/EP 05257525 dated Jun. 21, 2007 (pp. 6).

* cited by examiner

*Primary Examiner*—Michael Leslie
(74) *Attorney, Agent, or Firm*—Conley Rose, P.C.

(57) ABSTRACT

Apparatus and method for applying radial compressive stress pre-loading to a cylinder liner. A cylinder housing is attached to a pump, and a cylinder liner is disposed within the cylinder housing. A fluid inlet in fluid communication with the annular space between the cylinder housing and cylinder liner is disposed on the cylinder housing. The annular space is filled with pressurizing fluid through the fluid inlet, which creates radial compressive stress pre-loading on the cylinder liner.

20 Claims, 9 Drawing Sheets

CYLINDER LINER PRELOAD SYSTEM

CROSS-REFERENCE TO RELATED APPLICATIONS

The present application claims the benefit of, and incorporates by reference, provisional application Ser. No. 60/635,558, filed Dec. 13, 2004, and entitled "Cylinder Liner Preload System."

STATEMENT REGARDING FEDERALLY SPONSORED RESEARCH OR DEVELOPMENT

Not applicable.

FIELD OF THE INVENTION

The present invention relates generally to mud pumps and more particularly relates to a system for pre-loading the cylinder liners of such pumps. Still more particularly, the present invention relates to a compressive stress pre-loading system for the cylinder liner of a mud pump.

BACKGROUND

In extracting hydrocarbons from the earth, it is common to drill a borehole into the earth formation containing the hydrocarbons. A drill bit is attached to a drill string, and during drilling operations, drilling fluid, or "mud" as it is also known, is pumped down through the drill string and into the hole through the drill bit. Drilling fluids are used to lubricate the drill bit and keep it cool. The drilling mud also cleans the bit, balances pressure by providing weight downhole, and brings sludge and cuttings created during the drilling process up to the surface.

Slush or mud pumps are commonly used for pumping the drilling mud. The pumps used in these applications are reciprocating pumps typically of the duplex or triplex type. A duplex pump has two reciprocating pistons that each force drilling mud into a discharge line, while a triplex reciprocating pump has three pistons that force drilling mud into a discharge line. These reciprocating mud pumps can be single acting, in which drilling mud is discharged on alternate strokes, or double acting, in which each stroke discharges drilling mud.

The pistons and cylinders used for such mud pumps are susceptible to a high degree of wear during use because the drilling mud is relatively dense and has a high proportion of suspended abrasive solids. As the cylinder in which the piston reciprocates becomes worn, the small annular space between the piston head and the cylinder wall increases substantially and sometimes irregularly. This decreases the efficiency of the pump. To reduce the effect of this wear, the cylinder typically is provided with an expendable cylinder liner.

The abrasive nature of the drilling mud translates into a relatively short lifetime of the cylinder liner and necessitates frequent replacement, placing liner manufacturing costs and efficiency in the replacement process as a primary concern. Changing a cylinder liner in a mud pump is typically a difficult, dirty, and heavy job. Further, because drilling rig time is very expensive, frequent replacement of cylinder liners causes considerable inconvenience and can be quite costly if the system and apparatus for releasing the old cylinder liners and fitting the replacement cylinder liners are slow or difficult to operate. Thus, it is important to implement the system and method for removing and replacing the cylinder liners without undue effort and downtime.

The motion of the reciprocating pump piston subjects the cylinder liner to alternating axial forces and internal pressures. The alternating internal pressures translate to alternating radial stresses in the cylinder liners that can lead to metal fatigue from the cyclic loading and sudden changes in direction of the piston motion. To counteract the effects of fatigue, radial compressive stress pre-loading is applied to the cylinder liner such that the alternating internal pressure creates less stress than the pre-load stress.

The general construction of a mud pump cylinder liner typically involves using three pieces of tubular material: a sleeve, a hull, and a collar. The sleeve forms the inside surface of the liner, the hull is assembled by shrink fit over the sleeve, and the collar is a flange ring that is shrink fit around the hull and normally retains the liner in the mud pump cylinder. The shrink fit between the sleeve and the hull creates a mechanical radial compressive stress on the sleeve and serves to counteract the effects of the alternating axial compressive forces and internal pressures on the cylinder liner which can lead to fatigue and failure of the liner.

Each piece necessary to mechanically pre-load the cylinder liner adds to the cost and weight of the liner assembly. Such a system for applying radial compressive stress pre-loading to a cylinder liner may be difficult to operate for a variety of reasons, including the involvement of heavy components, the handling of which may be dangerous for operators. Certain of these types of systems require considerable strength of operators, together with the use of lifting devices in confined spaces. Thus, the removal and replacement of a typical multi-piece liner assembly can be costly financially, and may, in some instances, subject operators to risk of injury.

Accordingly, there remains a need for new and improved systems and apparatus for installing and pre-loading cylinder liners that address certain of the foregoing difficulties.

SUMMARY OF THE PREFERRED EMBODIMENTS

The embodiments of the present invention are directed to methods and apparatus for applying radial compressive stress pre-loading to the outer diameter of mud pump cylinder liners, preferably without utilizing an outer steel shell. It is desired to provide a cylindrical mud pump liner assembly that is lightweight and less costly than prior art mud pump liners.

In one embodiment, an assembly for applying radial compressive stress pre-loading to a replaceable cylinder liner comprises a cylinder housing attached to a pump and a cylinder liner disposed within the cylinder housing. A fluid inlet is located on the outer surface of the cylinder housing and is in fluid communication with an annular space between the cylinder housing and cylinder liner. Pressurizing fluid is pumped into the annular space between the cylinder liner and the cylinder housing. The pressurizing fluid creates radial compressive stress pre-loading on the cylinder liner substantially equivalent to mechanically created compressive stress in the current cylinder liners.

An isolation diaphragm is disposed about the outer diameter of the liner within the cylinder housing. The diaphragm forms a barrier between the pressurizing fluid and the outer surface of the liner, but is flexible in nature so as to allow the compressive stress generated by the pressurizing fluid to translate through to the liner. Diaphragm retaining members are removably engaged to the cylinder housing on both ends of the housing, thereby securing the isolation diaphragm. The barrier created by the diaphragm ideally serves to prevent both contamination of the liner area by the pressurizing fluid and fluid loss during the replacement of the liner.

In certain embodiments, an elastomeric coating is bonded to the outside surface of the liner. The elastomeric coating captures and retains liner fragments that would otherwise move freely throughout the cylinder housing after an occurrence of liner failure. In some embodiments, the elastomeric coating acting alone has the added effect of reducing the fluid volume required to pressurize the liner, or may act in concert with an elastomer jacket also disposed about the cylinder liner to further reduce the required pressurizing fluid volume.

Thus, the present invention comprises a combination of features and characteristics that are directed to overcoming various shortcomings of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
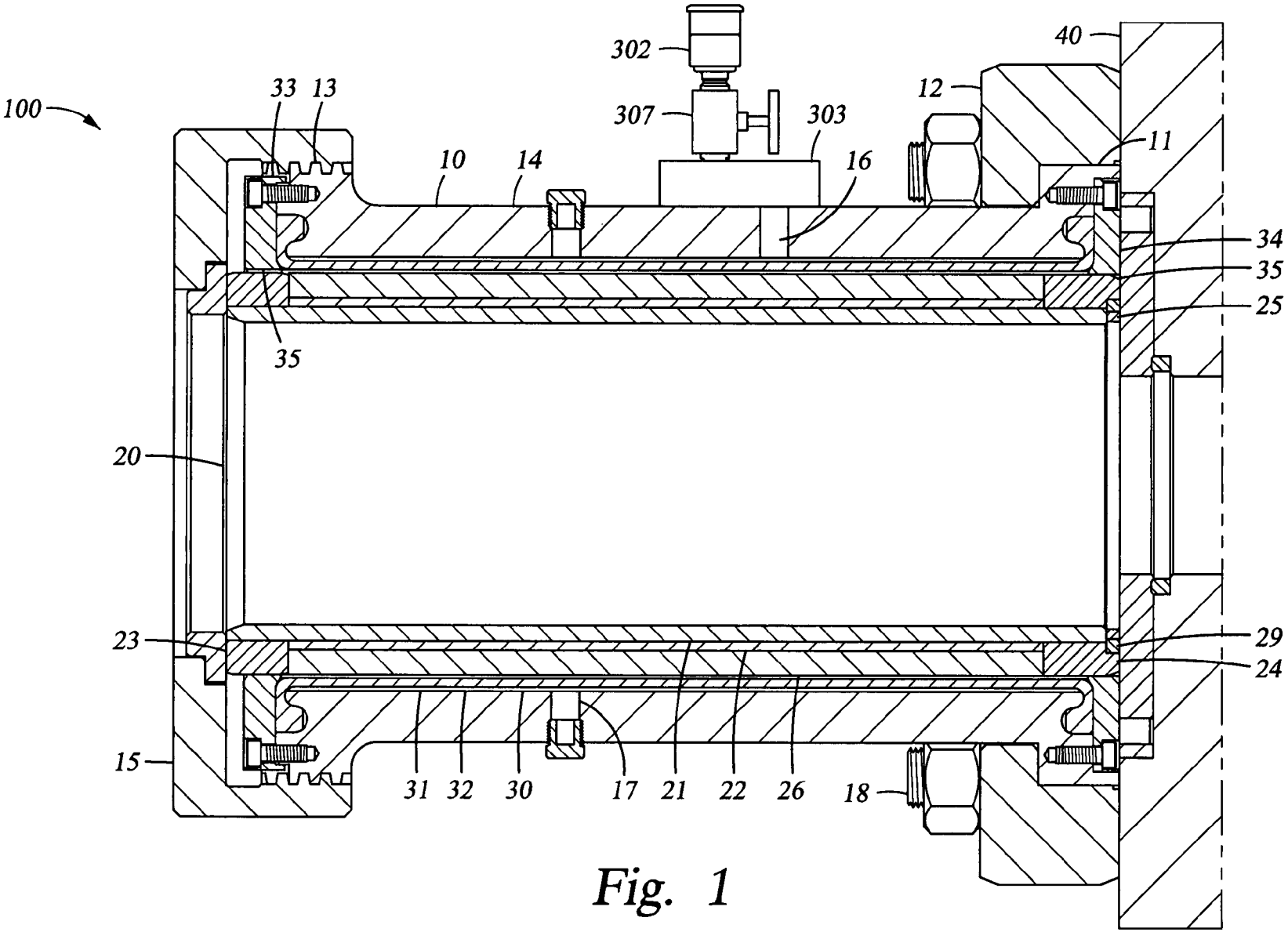
FIG. 1 is a cross-sectional view of one embodiment of the liner cartridge system and cylinder housing.

In the description that follows, like parts are marked throughout the specification and drawings with the same reference numerals, respectively. The drawing figures are not necessarily to scale. Certain features of the invention may be shown exaggerated in scale or in somewhat schematic form, and some details of conventional elements may not be shown in the interest of clarity and conciseness. The present invention is susceptible to embodiments of different forms. There are shown in the drawings, and herein will be described in detail, certain embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results.

Referring to FIG. 1, one embodiment of cylinder liner pre-loading system 100 includes cylinder housing 10, cylinder liner 20, clamping collar 12, and retaining nut 15. Clamping collar 12 secures system 100 to an existing mud pump module 40, such as via studs 18. Retaining nut 15 comprises a threaded surface complimentary to a threaded surface 13 present on outer surface 14 of cylinder housing 10. Thus, retaining nut 15 is secured to cylinder housing 10 through engagement of the complimentary threaded surfaces. Retaining nut 15 is alternatively secured to cylinder housing 10 through the use of threaded connectors, integrated clamps, or other attachment system.

Liner 20 is secured in cylinder housing 10 by retaining nut 15. A coating 22 is bonded to outer diameter 21 of liner 20, and an isolation diaphragm 32 is disposed around liner 20 within cylinder housing 10. Retainer caps 33 and 34 removeably attach to cylinder housing 10 to secure diaphragm 32 within cylinder housing 10. Retainer caps 33 and 34 also feature liner guides 35 which act as piloting points to aid in the alignment of liner 20 during insertion into cylinder housing 10.

Pressurizing fluid 31 is pumped into annular space 30 from an external source (not shown) through hose coupling 302, valve 307, manifold 303, and fluid inlet 16. Manifold 303 is attached to outer surface 14 of cylinder housing 10, and hose coupling 302 and valve 307 are threadingly mounted to manifold 303. Fluid inlet 16 is in fluid communication with manifold 303 and annular space 30. In one embodiment, hydraulic oil serves as the pressurizing fluid 31 and is pressurized by an external pump (not shown) to create radial compressive stress pre-loading on outer diameter 21 of liner 20. Other embodiments may entail the use of water, glycol, or other medium as pressurizing fluid 31.

Diaphragm 32 is a flexible membrane formed so that the compressive stress created by pressurizing fluid 31 may be translated to outer diameter 21 of liner 20. Moreover, diaphragm 32 serves to seal pressurizing fluid 31 in annular space 30 to prevent contamination in the area of mud pump piston operation and to prevent the escape of pressurizing fluid 31 during the replacement of liner 20. Diaphragm 32 is preferably sufficiently flexible so as to adapt to the different sizes of cylinder liners that may be used within cylinder housing 10. Specifically, it is preferred that diaphragm 32 has the ability to expand or contract while continuing to provide the appropriate sealing function according to the varying sizes of cylinder liners that may be utilized in a particular configuration of the mud pump.

Diaphragm 32 may also exhibit "shape memory" in that diaphragm 32 retains the ability to return to a baseline shape at the inception of each replacement process for liner 20. The ability of diaphragm 32 to return to a baseline shape provides the additional benefit of displacing pressurizing fluid 31 out of annular space 30 when the fluid pressure is released, thereby assisting in the removal and replacement process of liner 20. In order to provide the features described above, diaphragm 32 preferably consists of an elastomer material such as nitrile rubber or similar materials.

Figure 2:
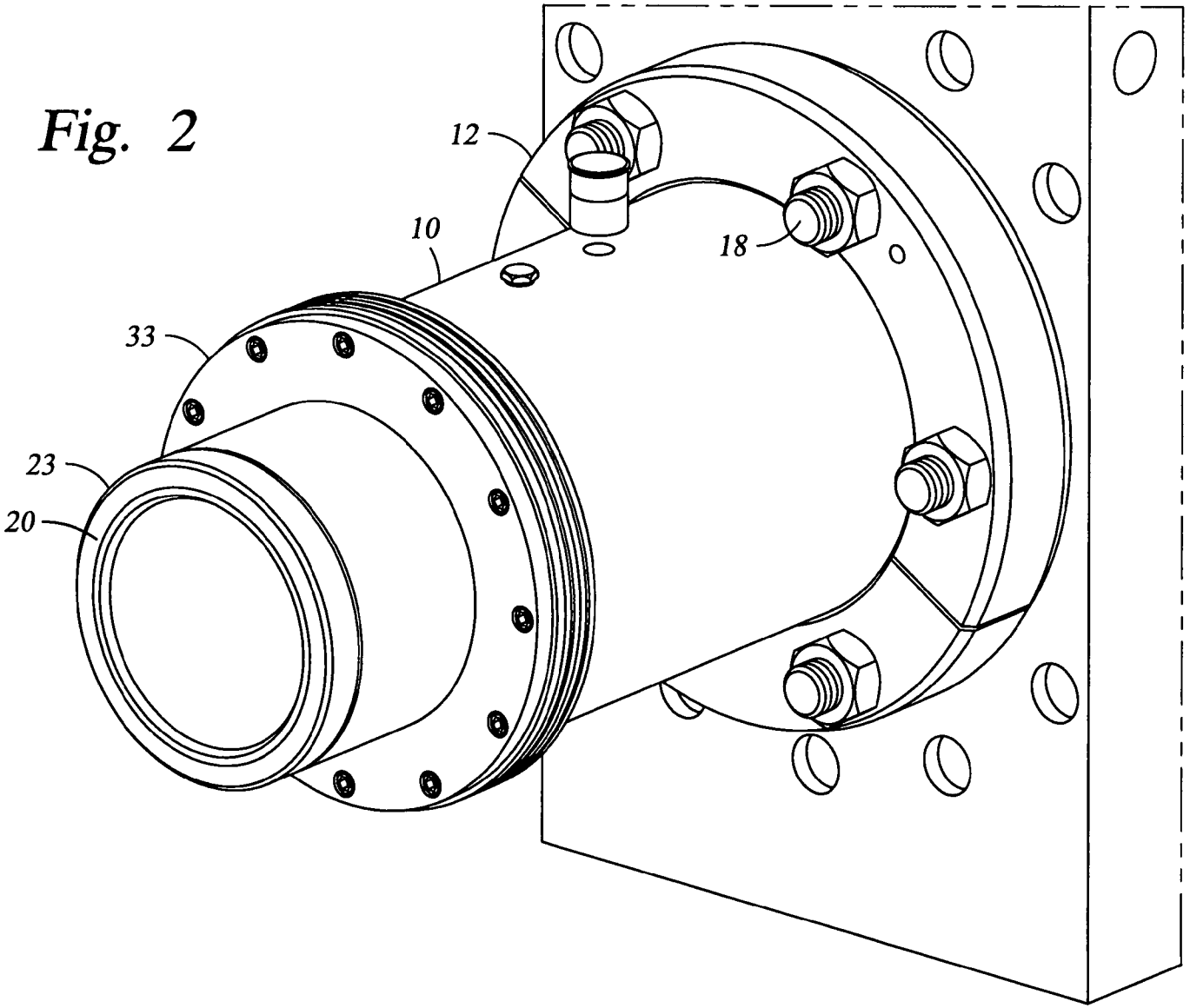
FIG. 2 is an isometric view of the power end of the cylinder housing with cylinder liner partially extracted from the cylinder housing.

Cylinder housing 10 is mounted to pump module 40, and is substantially cylindrical and includes an annular shoulder 11. Clamping collar 12 engages annular shoulder 11 and secures cylinder housing 10 to pump module 40 through a series of threaded connectors such as studs 18 disposed in a pattern matching existing connection points on pump module 40. As shown in FIG. 2, clamping collar 12 consists of two semicircular bushings symmetrically disposed about the circumference of cylinder housing 10. Referring again to FIG. 1, liner seal 25 is preferably positioned between cylinder liner 20 and pump module 40 to sealingly engage liner 20 to pump module 40. Spacer 29 is disposed in the annular space between liner seal 25 and coating 22.

Referring again to FIG. 2, liner 20 is shown partially extracted from cylinder housing 10, indicative of the initial steps in the liner replacement procedure. Referring again to FIG. 1, the liner replacement process begins with the release of pressure on pressurizing fluid 31. Retaining nut 15 is detached from cylinder housing 10, exposing liner 20, as shown in FIG. 2. Liner 20 is slidingly removed from its position in cylinder housing 10, and a replacement liner is then inserted into position. Referring again to FIG. 1, retaining nut 15 is re-secured to cylinder housing 10, and pressurizing fluid 31 is re-pressurized to provide radial compressive stress pre-loading on new liner 20.

Figure 3:
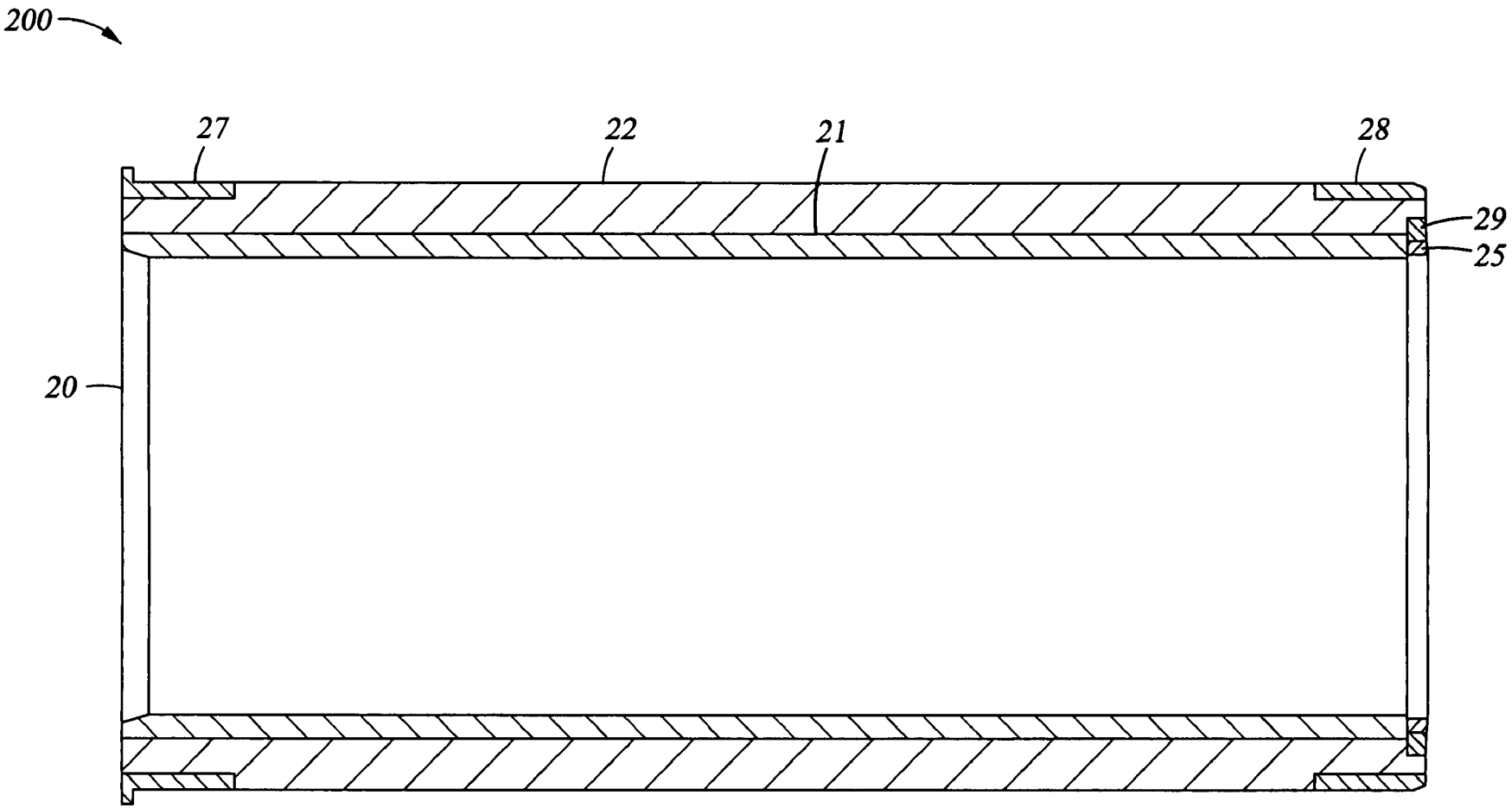
FIG. 3 is a cross-sectional view of the liner cartridge system with metal rings.
Figure 4:
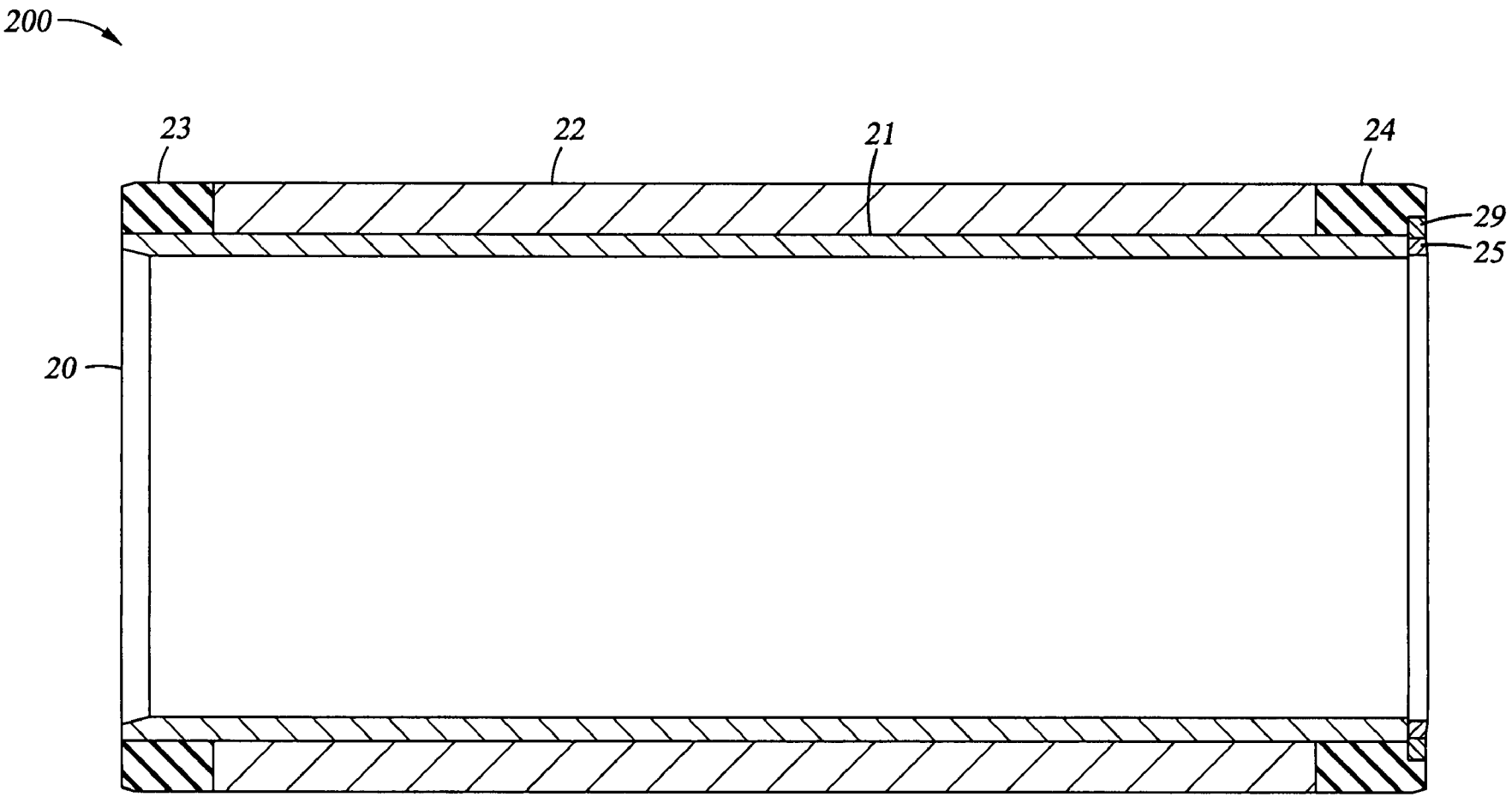
FIG. 4 is a cross-sectional view of the liner cartridge system with elastomer rings.
Figure 5:
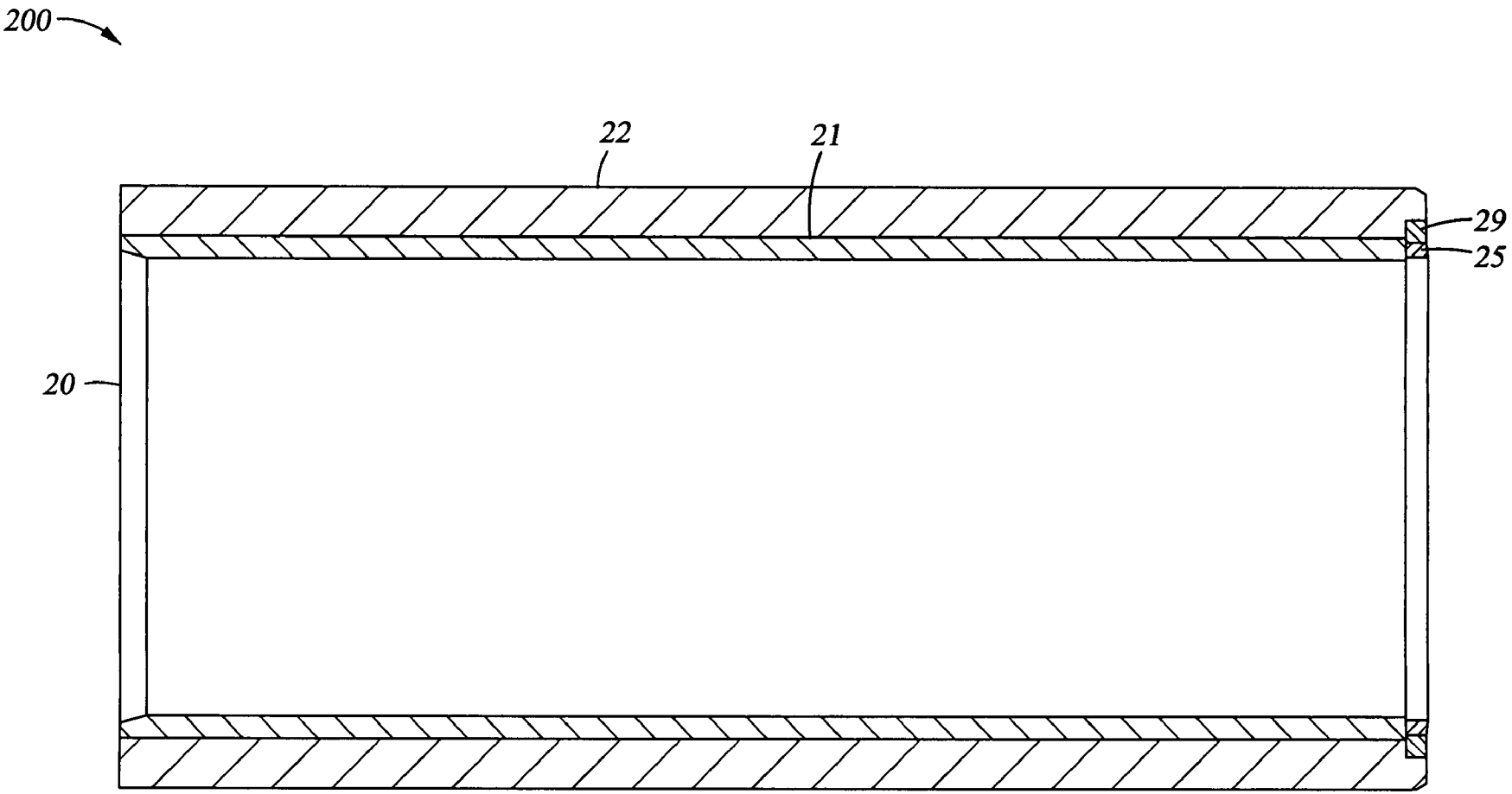
FIG. 5 is a cross-sectional view of the liner cartridge system with bonded coating.

Cylinder liner 20 is concentrically disposed within cylinder housing 10. Referring to FIG. 3, in one embodiment of liner cartridge system 200 coating 22 encircles liner 20 and is bonded to outer diameter 21 of liner 20, and metal rings 27 and 28 are disposed on opposite ends of cylinder liner 20. Referring to FIG. 4, an alternative embodiment of liner cartridge system 200 comprises disposing elastomer rings 23 and 24 on opposite ends of cylinder liner 20. Referring to FIG. 5, in another alternative embodiment of liner cartridge system 200 cylinder 20 is shown with a homogeneous application of coating 22 bonded to outer diameter 21 or liner 20, and without metal rings 27 and 28 or elastomer rings 23 and 24 disposed on liner 20. In this embodiment, coating 22 may comprise an elastomer material, or may alternatively comprise a metal sleeve that surrounds liner 20. Referring to FIGS. 3-5, liner seal 25 and spacer 29 are disposed at an end of liner 20.

In preferred embodiments coating 22 is bonded to outer diameter 21, and functions to capture and retain pieces of liner 20 should liner 20 fail during mud pump operation. Coating 22 preferably comprises of polyurethane or nitrile rubber with thickness ranging from ⅛ inch to 1-⅝ inches. The capture and retaining function of coating 22 protects the mud pump piston and diaphragm 32 from damage incurred by undesirable contact with loose fragments of a failed liner 20. Coating 22 also serves as a limited backup for applying minimal radial compressive stress to liner 20 so that the mud pump can continue operating for a limited amount of time in the event of a loss of fluid pressure on liner 20. Coating 22 may alternatively comprise of a composite type material, or other material that may be bonded to liner 20.

Referring to FIG. 3, metal rings 27 and 28 preferably comprise of steel and assist with the alignment of liner 20 during insertion into cylinder housing 10. Metal rings 27 and 28 help keep liner 20 aligned relative to the centerline of the pump piston (not shown) by working in concert with liner guides 35. The use of metal rings 27 and 28 provides a durable embodiment that will not crack or chip and as a result is more suitable to repeated removal and insertion of liner 20.

Referring now to FIG. 4, elastomer rings 23 and 24 preferably comprise of a molded elastomer type material, and also assist with the alignment of liner 20 during insertion into cylinder housing 10. Elastomer rings 23 and 24 help keep liner 20 aligned relative to the centerline of the pump piston (not shown) by working in concert with liner guides 35. Elastomer rings 23 and 24 are preferably compressible due to their elastomer material, and thereby may be slightly compressed between liner 20 and liner guides 35. Liner 20 floats a small degree within cylinder housing 10 in order to maintain alignment between the centerlines of liner 20 and the pump piston and to prevent the components from interfering, allowing for longer service life of the liner and a reduction in liner wear. This feature also has the potential of compensating for the mechanical misalignment that is present in most mud pumps. Elastomer ring 24 is disposed on the end of liner 20 first inserted into cylinder housing 10 and is slightly smaller in diameter than elastomer ring 23 in order to facilitate the insertion of liner 20 into cylinder housing 10.

Figure 6:
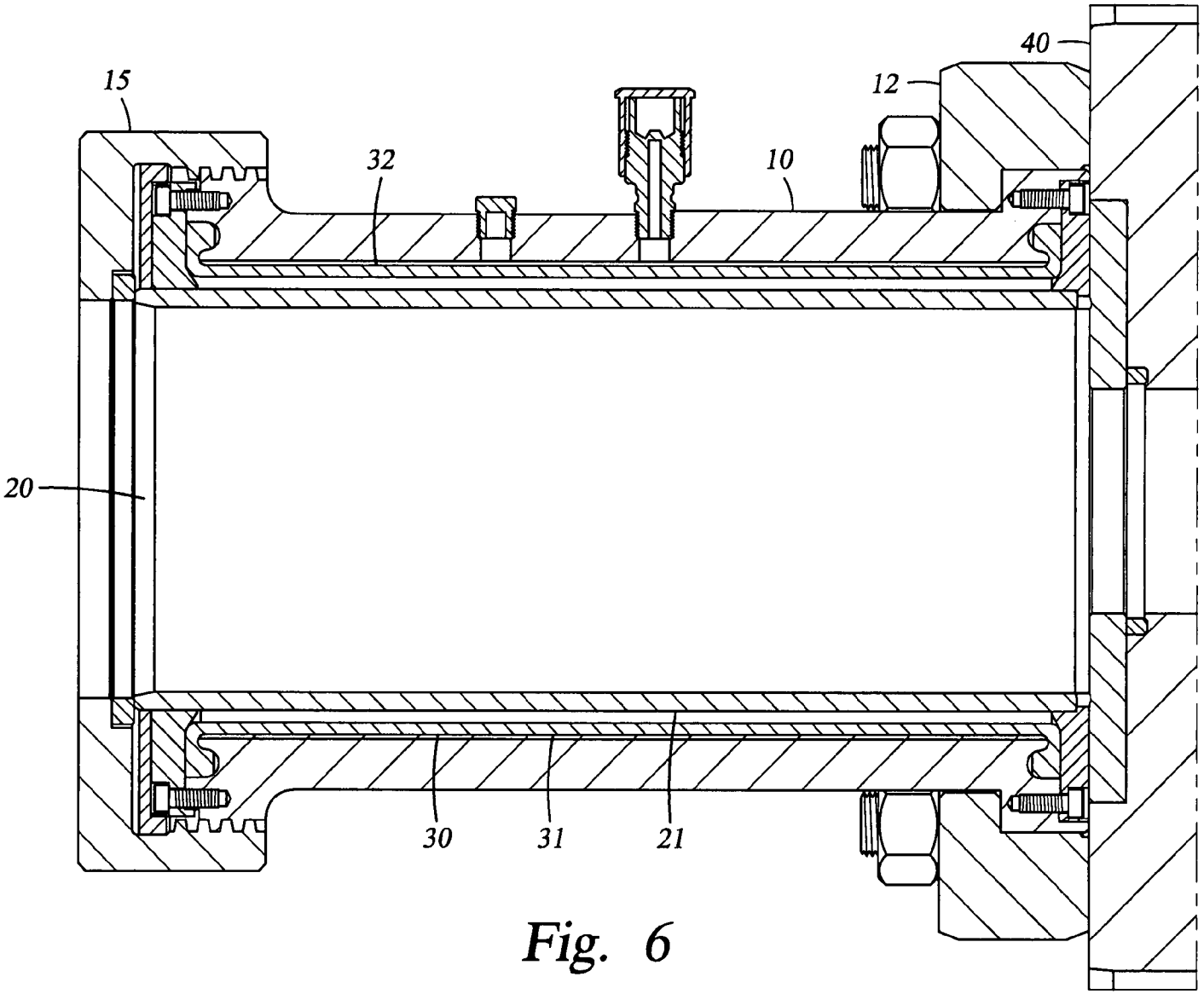
FIG. 6 is a cross-sectional view of one embodiment of cartridge liner system without the bonded coating.
Figure 7:
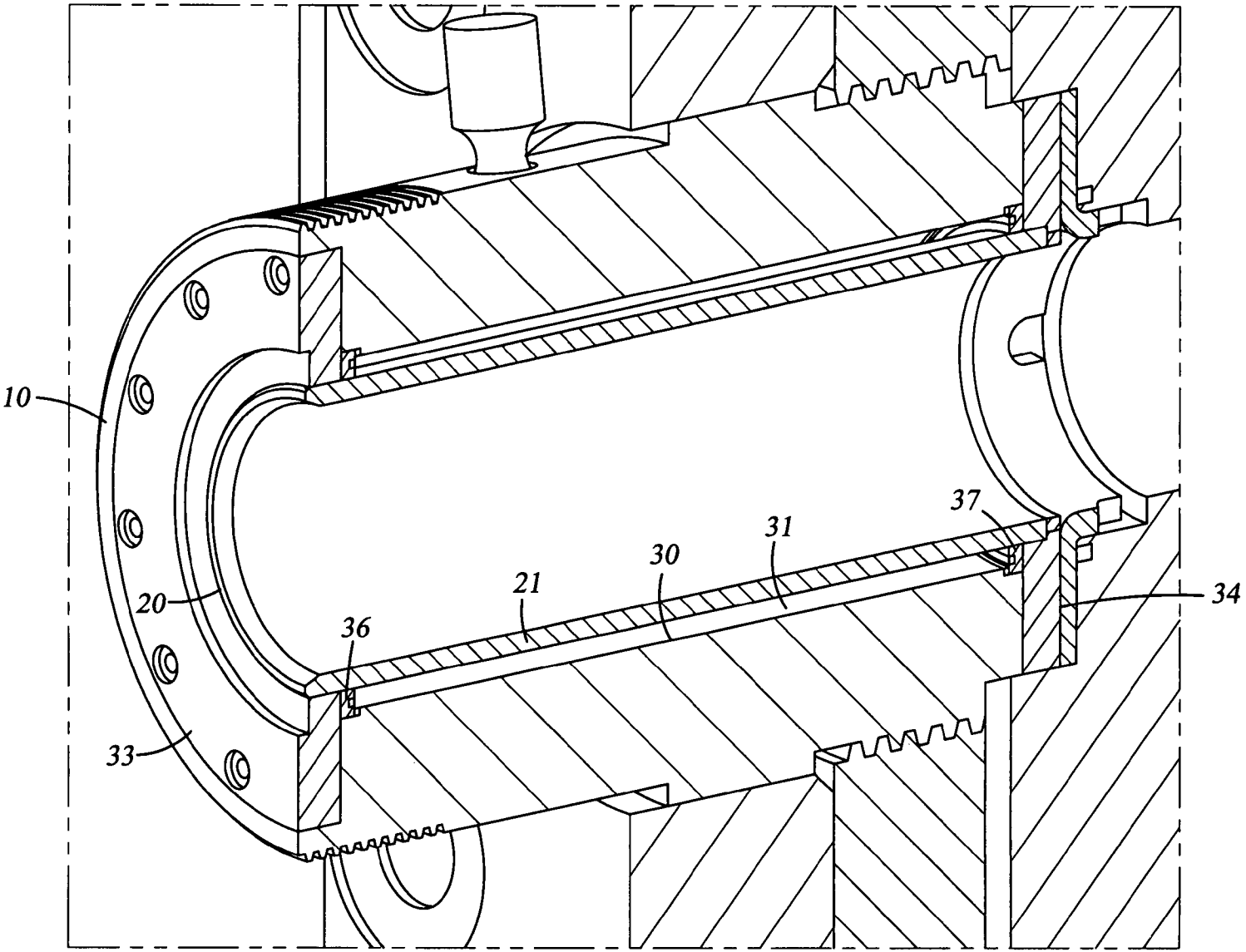
FIG. 7 is a cut away isometric view of the liner cartridge system with end seals.

Referring to FIG. 6, in another embodiment liner 20 is disposed within cylinder housing 10 without coating 22, metal rings 27 and 28, or elastomer rings 23 and 24. In this embodiment, diaphragm 32 creates a barrier in annular space 30 between outer diameter 21 of liner 20 and pressurizing fluid 31. Diaphragm 32 is intended to prevent both the contamination by pressurizing fluid 31 of the area of mud pump piston operation within liner 20 and the escape of pressurizing fluid 31 when liner 20 is removed for replacement. In an alternative sealing embodiment shown in FIG. 7, end seals 36 and 37 are disposed around outer surface 21 on opposite ends of liner 20 and are retained in position by retainer caps 33 and 34. End seals 36 and 37 function to seal annular space 30 so that pressurizing fluid 31 is kept within annular space 30, thereby preventing unwanted contamination or escape of pressurizing fluid 31.

Figure 8:
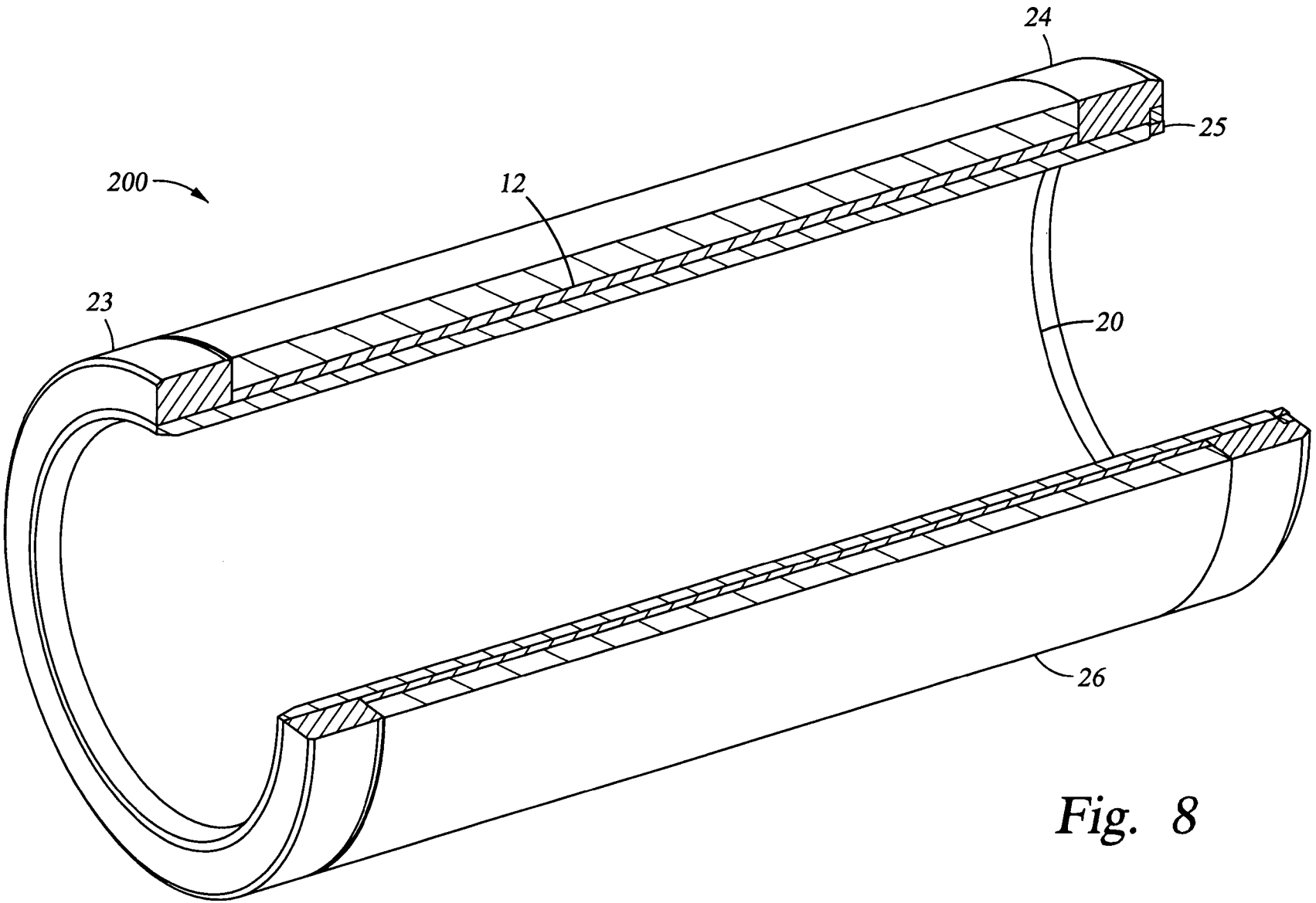
FIG. 8 is a cut away isometric view of the liner cartridge system with elastomer jacket.

Referring to FIG. 8, jacket 26 encircles liner 20 and coating 22 for the purpose of taking up volume inside cylinder housing 10. The effect of the embodiment that utilizes jacket 26 is to reduce the amount of pressurizing fluid 31 required to pre-load liner 20 when the use of a liner of lesser size is desired. Jacket 26 is preferably neoprene or a similar elastomer or synthetic rubber material.

It is intended that the replaceable liner system described herein is packaged in what is referred to as liner cartridge system 200. Referring again to FIG. 3, one embodiment of liner cartridge system 200 includes liner 20, coating 22, metal rings 27 and 28, liner seal 25, and spacer 29. Referring now to FIG. 4, another embodiment of liner cartridge system 200 includes liner 20, coating 22, elastomer rings 23 and 24, liner seal 25, and spacer 29. Referring now to FIG. 5, a further embodiment of liner cartridge system 200 includes liner 20, coating 22, liner seal 25, and spacer 29. Referring now to FIG. 8, an alternative embodiment of liner cartridge system 200 includes liner 20, coating 22, jacket 26, elastomer rings 23 and 24, and liner seal 25. In the embodiment shown in FIG. 8, metal rings 27 and 28 can be substituted for elastomer rings 23 and 24. It is preferred in all embodiments of liner cartridge system 200 shown in FIGS. 3-5 and 8 that liner 20 is removed and installed during the replacement process as a component of assembled liner cartridge system 200.

Figure 9:
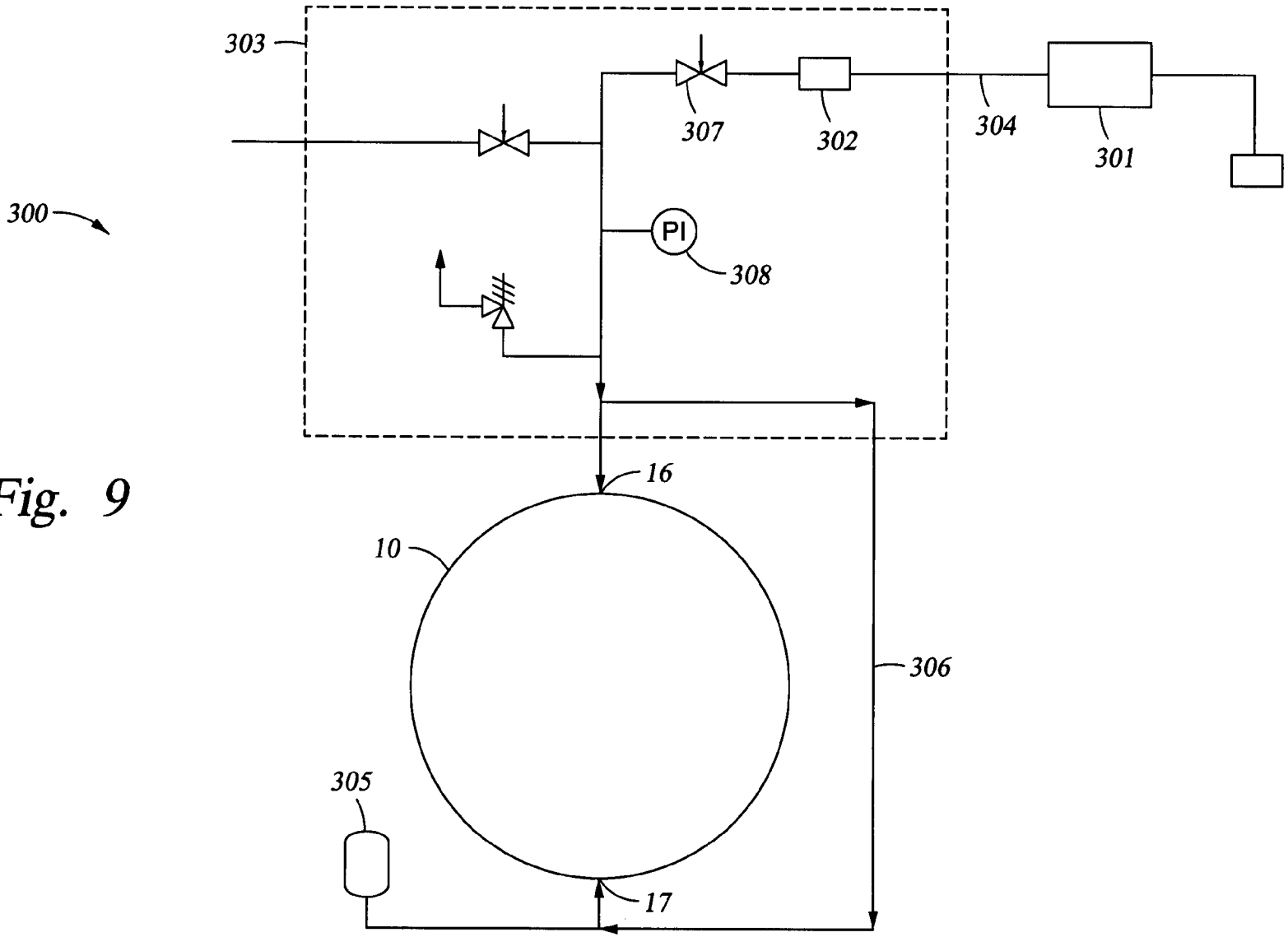
FIG. 9 is a schematic view of the hydraulic pressurizing system.

Referring now to FIG. 9, one embodiment of hydraulic system 300 includes pump 301, hose coupling 302, manifold 303, supply line 304, accumulator 305, hose 306, valve 307, and gauge 308. Pump 301 may be a hand-powered or air-assist powered portable hydraulic pump. In alternative embodiments, pump 301 may be an air powered hydraulic pump that operates at shop or rig pressure. Hydraulic oil is supplied through pump 301 and supply line 304 to cylinder housing 10 and is utilized as pressurizing fluid 31. Accumulator 305 stores hydraulic oil that is utilized in hydraulic system 300 as pressurizing fluid 31. In other embodiments, supply tanks (not shown) may be utilized to store hydraulic oil that is delivered to cylinder housing 10.

Supply line 304 is attached between pump 301 and hose coupling 302. Hose coupling 302 is attached to valve 307, wherein valve 307 is threadingly incorporated into manifold 303. Manifold 303 is mounted to outer surface 14 of cylinder housing 10 and features various ports that may be utilized within hydraulic system 300, such as a port for gauge 308. Manifold 303 is also ported for fluid communication with fluid inlet 16 and hose 306. Hydraulic fluid enters manifold 303 from supply line 304 and hose coupling 302, and flows into fluid inlet 16 and hose 306. Hose 306 is attached to fluid inlet 17 on outer surface 14 of cylinder housing 10. Hydraulic fluid used as pressurized fluid 31 travels and into cylinder housing 10 through fluid inlet 16 and circulates through hose 306 and fluid inlet 17, thereby providing the means to apply compressive pressure to liner 20.

The pressure applied to outer diameter 21 of liner 20 may vary from 2,000 to 5,000 PSI and can be monitored by gauge 308 in order to determine when the desired radial compressive stress pre-loading level has been applied to outer diameter 21 of liner 20. Additionally, hydraulic system 300 may be a pressure-balanced system with a hydraulic oil make-up feature in order to maintain a constant system pressure. Hydraulic system 300 may also be configurable in nature so as to include hydraulic fluid supply and return lines in configuration and number for compatible operation with multiple duplex or triplex reciprocating mud pumps with cylinder liner pre-loading system 100.

The use of pressurizing fluid 31 to apply radial compressive stress pre-loading to liner 20 in the embodiments described above makes it possible for a single operator to remove and replace a worn or damaged liner 20 without the use of heavy lifting tools and with reduced possibility for injury. An additional benefit resulting from the use of pressurizing fluid 31 to apply radial compressive stress pre-loading to liner 20 includes minimizing the small annular space between the outer diameter of the pump piston and inner diameter of the cylinder liner, thus extending the useful service life of the piston. Further, the application of radial compressive stress pre-loading on outer diameter 21 of liner 20 by surrounding the liner with pressurizing fluid 31 may be employed to eliminate the need for mechanically creating radial compressive stress pre-loading on liner 20.

Alternatively, the method of creating radial compressive stress pre-loading on a mud pump liner through the application of pressurized fluid may be combined with the mechanical components practiced in the prior art. For example, in certain embodiments a cylinder liner may have a hull or other tubular member that is assembled via shrink fit over the liner that creates a mechanical radial compressive stress on the liner in addition to the presence of a pressurizing fluid in the annular space between the liner and cylinder housing. Embodiments of this nature can provide the capability for redundant or backup radial compressive stress application to a cylinder liner.

While preferred embodiments have been shown and described, modifications thereof can be made by one skilled in the art without departing from the scope or teaching herein. The embodiments described herein are exemplary only and are not limiting. Because many varying and different embodiments may be made within the teachings of this disclosure, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. An assembly for pre-loading a cylinder liner, the assembly comprising:

a cylinder housing attached to a pump;

a cylinder liner disposed within said cylinder housing;

a diaphragm encircling said cylinder liner;

a fluid inlet disposed on said cylinder housing, wherein said fluid inlet is in fluid communication with an annular space between the cylinder housing and the cylinder liner; and wherein the annular space is filled with a pressurizing fluid.

2. The assembly of claim 1 further comprising a coating bonded to said cylinder liner.

3. The assembly of claim 2 wherein an elastomer jacket encircles said coating.

4. The assembly of claim 2 further comprising a first ring disposed about a first end of said cylinder liner and a second ring disposed about a second end of said cylinder liner, wherein said first ring and said second ring operate to align said cylinder liner within said cylinder housing.

5. The assembly of claim 4 wherein said first ring and said second ring are comprised of steel.

6. The assembly of claim 4 wherein said first ring and said second ring are comprised of molded elastomer.

7. The assembly of claim 1 wherein said pressurizing fluid is hydraulic fluid.

8. The assembly of claim 7 wherein said hydraulic fluid is placed under pressure and creates a radial compressive stress on said cylinder liner.

9. The assembly of claim 1 wherein said pressurizing fluid is glycol.

10. The assembly of claim 1 wherein said pressurizing fluid is applied at a range of 2,000 PSI to 5,000 PSI.

11. The assembly of claim 1 further comprising a first seal is disposed about a first end of said cylinder liner and a second seal is disposed about a second end of said cylinder liner, wherein said first seal and said second seal operate to isolate said annular space.

12. A method for pre-loading a cylinder liner, the method comprising:

disposing the cylinder liner in a cylinder housing connected to a pump;

filling an annular space between the cylinder liner and the cylinder housing with a fluid;

applying a fluid pressure to the cylinder liner and creating radial compressive stress on the cylinder liner; and disposing a diaphragm in said annular space, wherein said fluid pressure is applied to said diaphragm and transferred to said cylinder liner.

13. The method of claim 12 further comprising bonding a coating to said cylinder liner.

14. A cylinder liner cartridge assembly for insertion into a cylinder housing, comprising:

a cylinder liner, wherein a coating is bonded to the cylinder liner;

a first ring disposed about a first end of the cylinder liner; and a second ring disposed about a second end of the cylinder liner, wherein the first ring and the second ring are configured to align the cylinder liner cartridge assembly within said cylinder housing.

15. The cylinder liner cartridge assembly of claim 14 wherein said first ring and said second ring are comprised of steel.

16. The cylinder liner cartridge assembly of claim 14 wherein said first ring and said second ring are comprised of molded elastomer.

17. The cylinder liner cartridge assembly of claim 16 wherein an elastomer jacket encircles said coating.

18. An assembly for pre-loading a cylinder liner, the assembly comprising:

a cylinder housing attached to a pump;

a cylinder liner disposed within the cylinder housing;

a coating bonded to the cylinder liner;

a diaphragm disposed in an annular space between the cylinder housing and cylinder liner; and a fluid inlet disposed on said cylinder housing, wherein the fluid inlet is in fluid communication with the annular space, and the annular space is filled with a pressurizing fluid.

19. The assembly of claim 18 further comprising a first ring disposed about a first end of said cylinder liner and a second ring disposed about a second end of said cylinder liner, wherein said first ring and said second ring operate to align said cylinder liner during insertion into said cylinder housing.

20. The assembly of claim 18 wherein an clastomer jacket encircles said coating.

* * * * *